US012697657B2

(12) United States Patent
Lowell et al.

(10) Patent No.: US 12,697,657 B2
(45) Date of Patent: Aug. 4, 2026

(54) CASTING CORE POST AND SOCKET JOINT

(71) Applicant: RTX Corporation, Farmington, CT (US)

(72) Inventors: Jordan T. Lowell, Crozet, VA (US); Anthony J. Del Boccio, Charlottesville, VA (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/813,484

(22) Filed: Aug. 23, 2024

(65) Prior Publication Data

US 2025/0065396 A1 Feb. 27, 2025

Related U.S. Application Data

(60) Provisional application No. 63/534,555, filed on Aug. 24, 2023.

(51) Int. Cl.
*B22C 9/10* (2006.01)
*B22C 9/06* (2006.01)

(52) U.S. Cl.
CPC ..... *B22C 9/061* (2013.01); *B22C 9/10* (2013.01)

(58) Field of Classification Search
CPC .. B22C 9/06; B22C 9/061; B22C 9/10; B22C 9/103
USPC ..... 164/369, 23, 27, 28
See application file for complete search history.

(56) References Cited

U.S. PATENT DOCUMENTS

| | | | | |
|---|---|---|---|---|
| 7,144,220 | B2 | 12/2006 | Marcin, Jr. | |
| 8,813,812 | B2 | 8/2014 | Kamel et al. | |
| 10,987,727 | B2 | 4/2021 | Propheter-Hinckley | |
| 11,440,146 | B1 | 9/2022 | Paulus et al. | |
| 12,337,378 | B2 * | 6/2025 | Del Boccio | B22C 9/10 |
| 2009/0056902 | A1 | 3/2009 | Dodds et al. | |
| 2012/0168108 | A1 | 7/2012 | Farris et al. | |
| 2013/0341822 | A1 * | 12/2013 | Ellgass | B22C 9/103 264/219 |
| 2020/0338630 | A1 | 10/2020 | Beele | |

FOREIGN PATENT DOCUMENTS

| | | | | |
|---|---|---|---|---|
| EP | 1611978 | A1 * | 1/2006 | B22C 21/14 |
| EP | 1652603 | A2 * | 5/2006 | B22C 21/14 |
| EP | 2554294 | A2 | 2/2013 | |

OTHER PUBLICATIONS

European Search Report dated Feb. 3, 2025 for European Patent Application No. 24196306.5.
European Office Action dated Sep. 29, 2025 for European Patent Application No. 24196306.5.

* cited by examiner

*Primary Examiner* — Kevin P Kerns
(74) *Attorney, Agent, or Firm* — Bachman & LaPointe, P.C.

(57) ABSTRACT

A casting core assembly has: a first ceramic piece including a projecting post; a second ceramic piece including a socket encircling the post; and a ceramic filler material between the post and the socket. At least one of: in axial section at at least one location the post has a lateral protrusion of at least 15 micrometers relative to a location proximal thereof; and in axial section at at least one location socket has a lateral recess of at least 15 micrometers relative to a location outboard thereof.

22 Claims, 12 Drawing Sheets

CASTING CORE POST AND SOCKET JOINT

CROSS-REFERENCE TO RELATED APPLICATION

Benefit is claimed of U.S. Patent Application No. 63/534,555, filed Aug. 24, 2023, and entitled "Casting Core Post and Socket Joint", the disclosure of which is incorporated by reference herein in its entirety as if set forth at length.

BACKGROUND

The disclosure relates to gas turbine engines. More particularly, the disclosure relates to assembly of ceramic casting core pieces to each other.

Gas turbine engines (used in propulsion and power applications and broadly inclusive of turbojets, turboprops, turbofans, turboshafts, industrial gas turbines, and the like) have components cast with internal passageways (e.g., for cooling). The passageways may be cast over casting cores such as in an investment casting process.

In such casting, core assemblies may be used. Some assemblies include separate ceramic pieces assembled to each other. In some examples, one ceramic piece may be molded having projections or posts whereas a mating ceramic piece may be molded having respective associated sockets or holes.

Example posts and sockets have essentially circular transverse cross-section. The post may have a slight proximal-to-distal taper in order to facilitate mold release. Similarly, the socket may have an opening-to-base taper. If a flexible mold (e.g., elastomeric such as silicone) is used, the taper or drift may not be needed. Such an elastomeric mold may be used to manufacture core shapes that would not be removable from a hard die due to backlocking. The elastomeric mold may be a liner for a hard (e.g., metallic) tool. After molding, the tool may disengage from the liner and then the liner may be removed from the molded core. In alternative implementations, the overall profile of the core piece that will have the socket may be molded but the socket may be machined. Example machining is CNC machining via carbide ball end mill.

In general, in the assembled condition, there will be a very slight radial clearance. An example radial clearance is about 0.003 inch (0.08 mm). The clearance or gap may be filled with a ceramic filler material (e.g., alumina- and/or silica-based material applied as a paste and subsequently cured). An example paste is introduced by injecting into the socket or applying to the tip of the post prior to core assembly.

In one example, the posts are on the inboard/inside face of a skin core near the upstream end (relative to internal cooling flow of the cast part) thereof. An opposite downstream end portion of the skin core may embed in a shell to cast outlets or may be spaced apart from an interior wall of the shell so that outlets must be subsequently machined in the casting. The sockets are in a feed core. The posts may be taller than the sockets are deep so that, in the assembled condition, the posts protrude from the sockets holding adjacent surface portions of the two cores surrounding the posts and sockets spaced apart from each other for casting an interior wall section of the component. If the posts are shorter, one or both of the cores may be molded with tapering bumpers (e.g., conical, frustoconical, and/or domed) near the posts that contact the other to provide a desired spacing for casting the wall section. In such a situation, the contact between the bumper and other core may leave a small hole in the wall.

After decoring, the exposed portion of each post leaves an associated feed aperture from the feed passageway into the skin passageway.

U.S. Pat. No. 10,987,727B2 (the '727 patent), of Propheter-Hinckley, Apr. 27, 2021, and entitled "Investment Casting Core System", the disclosure of which is incorporated by reference herein in its entirety as if set forth at length, discloses posts or pins of a skin core received in sockets or holes in a feed core. The particular variation shown involves the feed core having an access slot open to the hole. The slot provides access for an injector to inject a ceramic bonding agent.

SUMMARY

One aspect of the disclosure involves a casting core assembly comprising: a first ceramic piece including a projecting post; a second ceramic piece including a socket encircling the post; and a ceramic filler material between the post and the socket. At least one of: in axial section at at least one location the post has: a lateral protrusion of at least 15 micrometers relative to a location proximal thereof; and in axial section at at least one location the socket has: a lateral recess of at least 15 micrometers relative to a location outboard thereof.

In a further embodiment of any of the foregoing embodiments, additionally and/or alternatively the socket is a closed-ended socket.

In a further embodiment of any of the foregoing embodiments, additionally and/or alternatively, at least one of: the protrusion is full annulus; and the recess is full annulus.

In a further embodiment of any of the foregoing embodiments, additionally and/or alternatively, both of: the post has said lateral protrusion; and the socket has said lateral recess.

In a further embodiment of any of the foregoing embodiments, additionally and/or alternatively, the protrusion is full annulus; and the recess is full annulus.

In a further embodiment of any of the foregoing embodiments, additionally and/or alternatively: the protrusion has an outward extreme; and the recess has an outward extreme axially outboard of the protrusion outward extreme.

In a further embodiment of any of the foregoing embodiments, additionally and/or alternatively: the protrusion is formed as a distal wall section of a full annulus recess in the post, a proximal wall section also being in the socket; and the recess is full annulus.

In a further embodiment of any of the foregoing embodiments, additionally and/or alternatively, the casting core assembly further comprises a second said post and a second said socket and a ceramic filler material between the second post and the second socket.

In a further embodiment of any of the foregoing embodiments, additionally and/or alternatively: the protrusion forms a distal wall of a post recess; the recess is recessed relative to portions of the socket inward and outward thereof.

In a further embodiment of any of the foregoing embodiments, additionally and/or alternatively, a separation $H_G$ between the first ceramic piece and the second ceramic piece aside the projection and the socket is 0.35 mm to 2.0 mm.

In a further embodiment of any of the foregoing embodiments, additionally and/or alternatively, in transverse section at at least one further location one of the post and the socket has a configuration of: three circumferentially offset radial peaks of a peak radius ($R_{PMAX1}$, $R_{SMAX1}$); and three radial troughs of a trough radius ($R_{PMIN1}$, $R_{SMIN1}$) not more than 98.0% of the peak radius.

In further embodiments said at least one further location may include two axially spaced locations of the one or the other of the post and socket.

In a further embodiment of any of the foregoing embodiments, additionally and/or alternatively, the radial troughs are along flats of the post.

In a further embodiment of any of the foregoing embodiments, additionally and/or alternatively: the trough radius is 93.0% to 97.0% the peak radius if said one is the post; and the trough radius is 93.0% to 97.0% the peak radius if said one is the socket.

In a further embodiment of any of the foregoing embodiments, additionally and/or alternatively, in said transverse section at said at least one further location the post has: respective convex regions spanning maxima of the peaks; and respective essentially straight regions spanning minima of the troughs.

In a further embodiment of any of the foregoing embodiments, additionally and/or alternatively, in said transverse section at said at least one further location the socket has: a radius of a minima within 5.0% of a radius of a maxima.

In a further embodiment of any of the foregoing embodiments, additionally and/or alternatively, the casting core assembly further comprises: a second said post and a second said socket and a ceramic filler material between the second post and the second socket.

In a further embodiment of any of the foregoing embodiments, additionally and/or alternatively, said at least one further location forms at least 30% of a depthwise overlap $H_O$ of the post and socket.

In a further embodiment of any of the foregoing embodiments, additionally and/or alternatively, a separation $H_G$ between the first ceramic piece and the second ceramic piece aside the projection and socket is 0.40 mm to 1.2 mm.

In a further embodiment of any of the foregoing embodiments, additionally and/or alternatively, the second ceramic piece forms a feedcore; and the first ceramic piece forms a skin core.

In a further embodiment of any of the foregoing embodiments, additionally and/or alternatively, the first ceramic piece has one or more bumpers protruding to contact the second ceramic piece.

In a further embodiment of any of the foregoing embodiments, additionally and/or alternatively, a method for manufacturing the casting core assembly comprises: molding the first and second ceramic pieces; injecting a ceramic paste into the socket; and inserting the post into the socket partially displacing the ceramic paste and causing the ceramic paste to flow outward at the radial troughs of the post or the radial peaks of the socket.

In a further embodiment of any of the foregoing embodiments, additionally and/or alternatively, the inserting also causes the ceramic paste to flow outward between the radial troughs of the post or the radial peaks of the socket.

In a further embodiment of any of the foregoing embodiments, additionally and/or alternatively, the post and socket are shaped so that with the post centered within the socket in transverse section at at least one location the post and socket define a gap having: three circumferentially offset first locations of local minimum radial span; and three circumferentially offset second locations of local maximum radial span. In embodiments, this may be at two axially spaced locations.

In a further embodiment of any of the foregoing embodiments, additionally and/or alternatively, the post and socket are shaped to provide means for improving flow of the ceramic filler while preserving a centering effect. The means may comprise circumferentially alternating local radial maxima and minima on at least one of the post and socket. If on both the post and socket, the radial maxima and minima of the post may respectively be in phase with the radial maxima and minima of the socket (e.g., up to 5.0° or 3.0° off exact in-phase.).

In a further embodiment of any of the foregoing embodiments, additionally and/or alternatively, the second ceramic piece forms a feedcore; and the first ceramic piece forms a skin core.

In a further embodiment of any of the foregoing embodiments, additionally and/or alternatively, the first ceramic piece has one or more bumpers protruding to contact the second ceramic piece.

In a further embodiment of any of the foregoing embodiments, additionally and/or alternatively, a method for manufacturing the casting core assembly comprises: introducing a ceramic paste into the socket; and inserting the post into the socket, the inserting displacing the ceramic paste, the ceramic paste hardening to form the ceramic filler material.

In a further embodiment of any of the foregoing embodiments, additionally and/or alternatively, he method further comprises forming the second ceramic piece by: molding; and machining the socket, the machining including an orbit of a ball mill cutting the recess.

In a further embodiment of any of the foregoing embodiments, additionally and/or alternatively, the ball mill cutting is into a wall surface formed by ball end mill cutting with a different bit.

In a further embodiment of any of the foregoing embodiments, additionally and/or alternatively, a method for using the casting core assembly comprises: wax overmolding; shelling to form a shell; and casting an alloy in the shell.

In a further embodiment of any of the foregoing embodiments, additionally and/or alternatively, the method further comprises: deshelling and decoring.

A further aspect of the disclosure involves, a casting core assembly comprising: a first ceramic piece including a projecting post; a second ceramic piece including a socket encircling the post; and a ceramic filler material between the post and the socket. At least one of the post and the socket has a full annular recess into which the ceramic filler material extends.

A further aspect of the disclosure involves, a casting core assembly comprising: a first ceramic piece including a projecting post; a second ceramic piece including a socket; and a ceramic filler material between the post and the socket. The ceramic filler is axially backlocked to the post and the socket to prevent nondestructive extraction of the post from the socket.

In a further embodiment of any of the foregoing embodiments, additionally and/or alternatively, the ceramic filler is axially backlocked to the post and the socket by at least 10 micrometers.

In a further embodiment of any of the foregoing embodiments, additionally and/or alternatively, each of the post and the socket has a full annular recess into which the ceramic filler material extends.

A further aspect of the disclosure involves a casting core assembly comprising: a first ceramic piece including a projecting post; a second ceramic piece including a socket; and a ceramic filler material between the post and the socket. In transverse section at at least one location one of the post and socket has a configuration of: three circumferentially offset radial peaks of a peak radius ($R_{PMAX1}$, $R_{SMAX1}$); and three radial troughs of a trough radius ($R_{PMIN1}$, $R_{SMIN1}$) not more than 98.0% of the peak radius.

In a further embodiment of any of the foregoing embodiments, additionally and/or alternatively, the socket is a closed-ended socket.

In a further embodiment of any of the foregoing embodiments, additionally and/or alternatively: the trough radius is 93.0% to 97.0% the peak radius if said one is the post; and the trough radius is 93.0% to 97.0% the peak radius if said one is the socket.

In a further embodiment of any of the foregoing embodiments, additionally and/or alternatively, in said transverse section at said at least one location the post has: respective convex regions spanning maxima of the peaks; and respective essentially straight regions spanning minima of the troughs.

In a further embodiment of any of the foregoing embodiments, additionally and/or alternatively, in said transverse section at said at least one location the socket has: a radius of a minima within 5.0% of a radius of a maxima.

In a further embodiment of any of the foregoing embodiments, additionally and/or alternatively, the casting core assembly further comprises: a second said post and a second said socket and a ceramic filler material between the second post and the second socket.

In a further embodiment of any of the foregoing embodiments, additionally and/or alternatively, said at least one location forms at least 30% of a depthwise overlap $H_O$ of the post and socket.

In a further embodiment of any of the foregoing embodiments, additionally and/or alternatively, a separation $H_G$ between the first ceramic piece and the second ceramic piece aside the projection and socket is 0.40 mm to 1.2 mm.

In a further embodiment of any of the foregoing embodiments, additionally and/or alternatively, the second ceramic piece forms a feedcore; and the first ceramic piece forms a skin core.

In a further embodiment of any of the foregoing embodiments, additionally and/or alternatively, the first ceramic piece has one or more bumpers protruding to contact the second ceramic piece.

In a further embodiment of any of the foregoing embodiments, additionally and/or alternatively, a method for manufacturing the casting core assembly comprises: molding the first and second ceramic pieces; injecting a ceramic paste into the socket; and inserting the post into the socket partially displacing the ceramic paste and causing the ceramic paste to flow outward at the radial troughs of the post or the radial peaks of the socket.

In a further embodiment of any of the foregoing embodiments, additionally and/or alternatively, the method further comprises firing the first and second pieces after molding.

In a further embodiment of any of the foregoing embodiments, additionally and/or alternatively, the inserting also causes the ceramic paste to flow outward between the radial troughs of the post or the radial peaks of the socket.

In a further embodiment of any of the foregoing embodiments, additionally and/or alternatively, a method for using the casting core assembly comprises: wax overmolding; shelling to form a shell; and casting an alloy in the shell.

In a further embodiment of any of the foregoing embodiments, additionally and/or alternatively, the method of further comprises deshelling and decoring.

In a further embodiment of any of the foregoing embodiments, additionally and/or alternatively, the radial troughs are along flats of the post.

A further aspect of the disclosure involves a casting core assembly comprising: a first ceramic piece including a projecting post; a second ceramic piece including a socket; and a ceramic filler material between the post and the socket. The post and socket are shaped so that with the post centered within the socket in transverse section at at least one location the post and socket define a gap having: three circumferentially offset first locations of local minimum radial span; and three circumferentially offset second locations of local maximum radial span.

In a further embodiment of any of the foregoing embodiments, additionally and/or alternatively, a method for forming the casting core assembly comprises: introducing a ceramic paste into the socket; and inserting the post into the socket.

In a further embodiment of any of the foregoing embodiments, additionally and/or alternatively, the second locations of local maximum radial span are at outward recesses in the socket or flats of the post.

A further aspect of the disclosure involves a casting core assembly comprising: a first ceramic piece including a projecting post; a second ceramic piece including a socket; and a ceramic filler material between the post and the socket. The post and socket are shaped to provide means for improving flow of the ceramic filler while preserving a centering effect.

In a further embodiment of any of the foregoing embodiments, additionally and/or alternatively, the means may comprise circumferentially alternating local radial maxima and minima on at least one of the post and socket. If on both the post and socket, the radial maxima and minima of the post may respectively be in phase with the radial maxima and minima of the socket (e.g., up to 5.0° or 3.0° off exact in-phase).

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Post and socket bonding involves tight geometries (e.g., 0.003 inch (0.08 mm) nominal radial gap). This is required by balancing alignment precision (favoring smallest gap) against manufacturing tolerance (e.g., of spacing of posts and sockets).

The example bonding material is a ceramic filler material. Such material is typically alumina and/or silica fines (e.g., 0.00001 inch to 0.0005 inch (0.25 micrometers to 13 micrometers) in size) delivered as a paste (e.g., with a carrier of water or colloidal silica—such colloidal silica may be used with alumina and/or silica fines).

Figure 1:
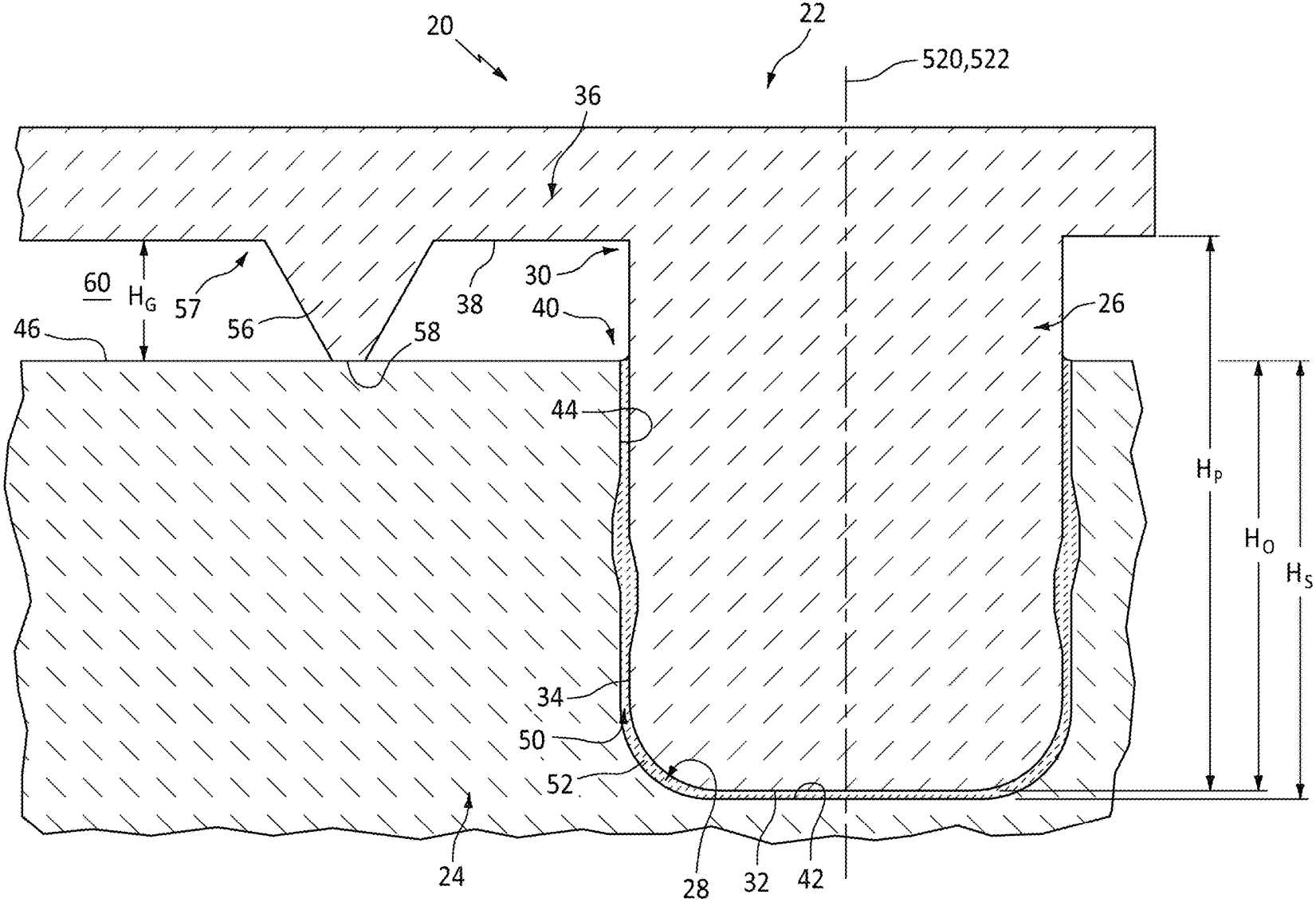
FIG. 1 is a longitudinal sectional view of a casting core post-and-socket joint.
Figure 1A:
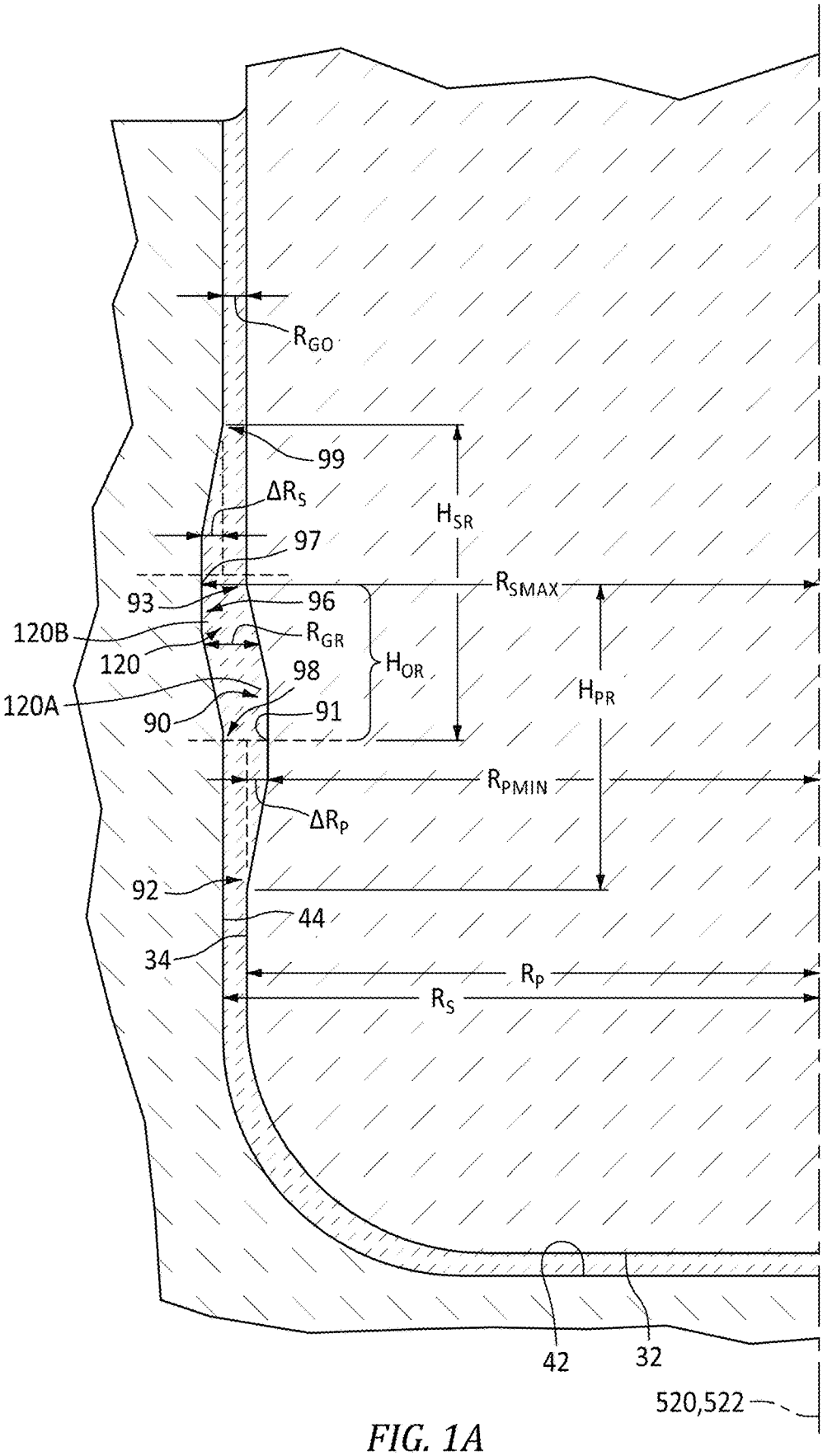
FIG. 1A is an enlarged half view of the joint if FIG. 1.

FIG. 1 shows a core assembly 20 having first core piece (first piece or first core) 22 having an integrally molded projection (post) 26 extending from a proximal end (root end) 30 to a free distal end (tip) 32 and having a peripheral wall surface 34. The proximal end merges with the remainder (e.g., at a body section 36) of the first piece which has a surface region 38 surrounding the proximal end 30. The post has a central axis (centerline) 520 and a height or length $H_P$.

FIG. 1 shows a second core piece (second piece or second core) 24 having an integrally molded socket 28. The example socket is a blind or closed-ended socket rather than a through-hole. Thus, the socket extends from an open outer end (opening) 40 to an inner base end (base) 42 and has a peripheral wall surface 44. As with the projection proximal end, the socket outer end or opening is to a surrounding outer surface 46. The socket has a central axis 522 and a height or depth $H_S$.

In a particular assembled condition with the post 26 coaxially seated (centered) in the socket 28, the gap 50 between them is filled with a ceramic filler material 52. As noted above, in the example implementation, the first core has bumpers 56 protruding from the surrounding surface 38. Each bumper extends from a proximal (root) end 57 to a distal end 58 that contacts the second core surrounding surface 46 so that the surrounding surfaces 38 and 46 are spaced apart from each other by a gap 60 that has a height $H_G$ which corresponds to the thickness of an internal wall to be cast.

In an alternative example implementation, the post is sufficiently taller $H_P$ than the socket is deep $H_S$ so that the post bottoms in the socket and the surrounding surfaces 38 and 46 are spaced apart from each other by the gap 60 of height $H_G$ without bumpers 56. In either situation, there is an axial/heightwise overlap span or zone of the post and socket having an overlap height $H_O$.

In use, as in the '727 patent, the second piece 24 may form a feed core and the first piece 22 may form a skin core/outlet core such as for casting an airfoil element (blade or vane). In such a situation, there may be two or more such projections 26 on the first piece received in corresponding sockets 28 in the second piece so as to substantially fully position the first piece relative to the second piece against movement transverse to the post/socket centerlines.

Manufacturing tolerances for either of the pieces highlight the need for nominal clearances/gaps between the projections and the sockets. For example, manufacturing tolerances may cause the centerlines 520 of the projections of a given first piece to be slightly closer to or further away from each other than the centerlines 522 of the sockets of a given second piece to which they are to mate. Thus, the nominal clearance is engineered in to allow such tolerance with limited scrappage. However, too much clearance and core alignment is compromised. Thus, increasing annular clearance between a circular socket and circular post to facilitate paste flow may reduce the positional accuracy of the two cores.

A baseline post and socket are of circular cross-section and respective radii $R_P$ and $R_S$ thus would have a nominal (ignoring manufacturing tolerances/variation) uniform centered gap of radial clearance $R_{G0}$ over a majority of the overlap. The radii may substantially taper near the post tip 32 and socket base 42 (e.g., a rounded corner to the respective cross-sections transitioning to flat transverse central portions of each). Additionally, there may be slight overall taper in radii due to small draft angles of the surfaces 34 and 44. However, $R_{G0}$ may be uniform along the region of such draft angle.

The ceramic filler material continuously adheres to the post and socket to prevent extraction of the post from the socket. Adhesion is not relevant to other movements (e.g., any lateral movements) as this is more than addressed by compressive strength of the filler. However, a number of factors may contribute to loss of adhesion. A loss of adhesion may allow the post to pull out slightly, to increase the height $H_G$ of the gap 60 and thereby increase the thickness of the internal wall. More significantly, that displacement also causes a corresponding decrease in thickness of the external/exterior wall of the part outboard of the first core piece.

The loss of adhesion may be due to one or more thermal and/or mechanical factors. Thermal events may cause differential thermal expansion to break the adhesion. Such thermal events may include a pre-firing of the shell containing the core assembly and include the metal pour contacting the core assembly. Additionally, the metal pour can impose mechanical stimulus to break adhesion. Additionally, pre-firing handling may break adhesion. Thus, it may be desirable to configure the filler to provide mechanical backlocking to maintain relative core position even if adhesion is broken.

In distinction and departure from a possible baseline, the post and/or socket wall surface 34, 44 has other than a straight cross-section along a portion of its height or depth and, in particular, along a portion of the overlap height $H_O$. The example FIG. 1/1A post cross-section has an annular recess 90 with a base minimum radius $R_{PMIN}$ and depth $\Delta R_P$. The example recess 90 has a center 91 between lower (distal) 92 and upper (proximal) 93 extremes/ends with a height $H_{PR}$ therebetween. These lower and upper extremes are at junctions with intact straight-sectioned portions of the surface 34. The example central location 91 is itself along a straight-sectioned base portion of the surface 34. Thus, the example recesses are channels having upper and lower walls formed by post or socket material above and below (as viewed in FIG. 1).

The example FIG. 1/1A socket cross-section similarly has an annular recess 96 with a base maximum radius $R_{SMAX}$ and depth $\Delta R_s$. Similarly to the post recess 90, the socket recess 92 has a central location 97 and lower (inboard) 98 and upper (outboard) 99 extremes/ends with a height $H_{SR}$ therebetween.

Example post recess radial depth $\Delta R_P$ is 1 mil (25 micrometers, more broadly at least 10 micrometers or at least 15 micrometers or an example 10 micrometers to 100 micrometers or 15 micrometers to 40 micrometers). Example socket recess radial depth $\Delta R_S$ is 1.35 mil (34 micrometers more broadly at least 10 micrometers or at least 15 micrometers or an example 10 micrometers to 200 micrometers of 15 micrometers to 50 micrometers).

Example socket depth $H_S$ is about 1.5 mm, more broadly 1.0 mm to 4.0 mm or 1.0 mm to 3.0 mm or 1.2 mm to 2.0 mm.

Example radius $R_S$ is about 1.0 mm for a cross-sectional area of about 3 $mm^2$. More broadly, example radius $R_S$ is about 0.6 mm to 2.0 mm for a cross-sectional area of about 1.1 $mm^2$ to 12.6 $mm^2$ or about 0.8 mm to 1.5 mm for a cross-sectional area of about 2.0 $mm^2$ to 7.1 $mm^2$.

Example recess heights $H_{PR}$ and $H_{SR}$ are at least 0.25 mm, more particularly, 0.25 mm to 2.5 mm or at least 20% of the associated radius $R_P$ or $R_S$ or $R_{PMIN}$ or $R_{SMAX}$, more particularly 20% to 80% or 25% to 50%. They may be similar fractions of the socket depth $H_S$ or the overlap height $H_O$. The example recesses 90 and 96 are axially partially overlapping along a recess overlap height $H_{OR}$. The example partial overlap involves a portion of the post recess 90 extending below the lower extreme 98 of the socket recess and a portion of the socket recess 92 extending above the upper extreme 93 of the post recess. However, other configurations are possible. Example $H_{OR}$ is up to 100% of (e.g., 30% to 100%) one or both of the recess heights $H_{PR}$ and $H_{SR}$.

The axial overlap helps create an enlarged radial section of the gap with radius $R_{GR}$ substantially greater than the radial gap $R_{GO}$ above and below. This creates a keying portion 120 of the filler that prevents extraction of the post from the socket even if adhesion of the filler to one or both of the post and socket is broken. This keying portion thus has nominal radial overlap with the socket and post of essentially the socket recess depth $\Delta R_S$ and post recess depth $\Delta R_P$, respectively. The keying portion itself has respective portions 120A, 120B keying with the post and socket respectively. In non-overlap situations, these may be viewed as a single keying portion joined by the filler material between them.

Even if there is a relative differential thermal expansion that breaks adhesion and creates a slight gap between the filler and one or both of the post and socket, there will still be sufficient radial overlap to provide backlocking because the lower wall surface of the post recess contacts the adjacent lower surface of the post keying portion 120A of the filler material and the upper surface of the socket recess contacts the upper surface of the filler material socket keying portion 120B.

Figure 2:
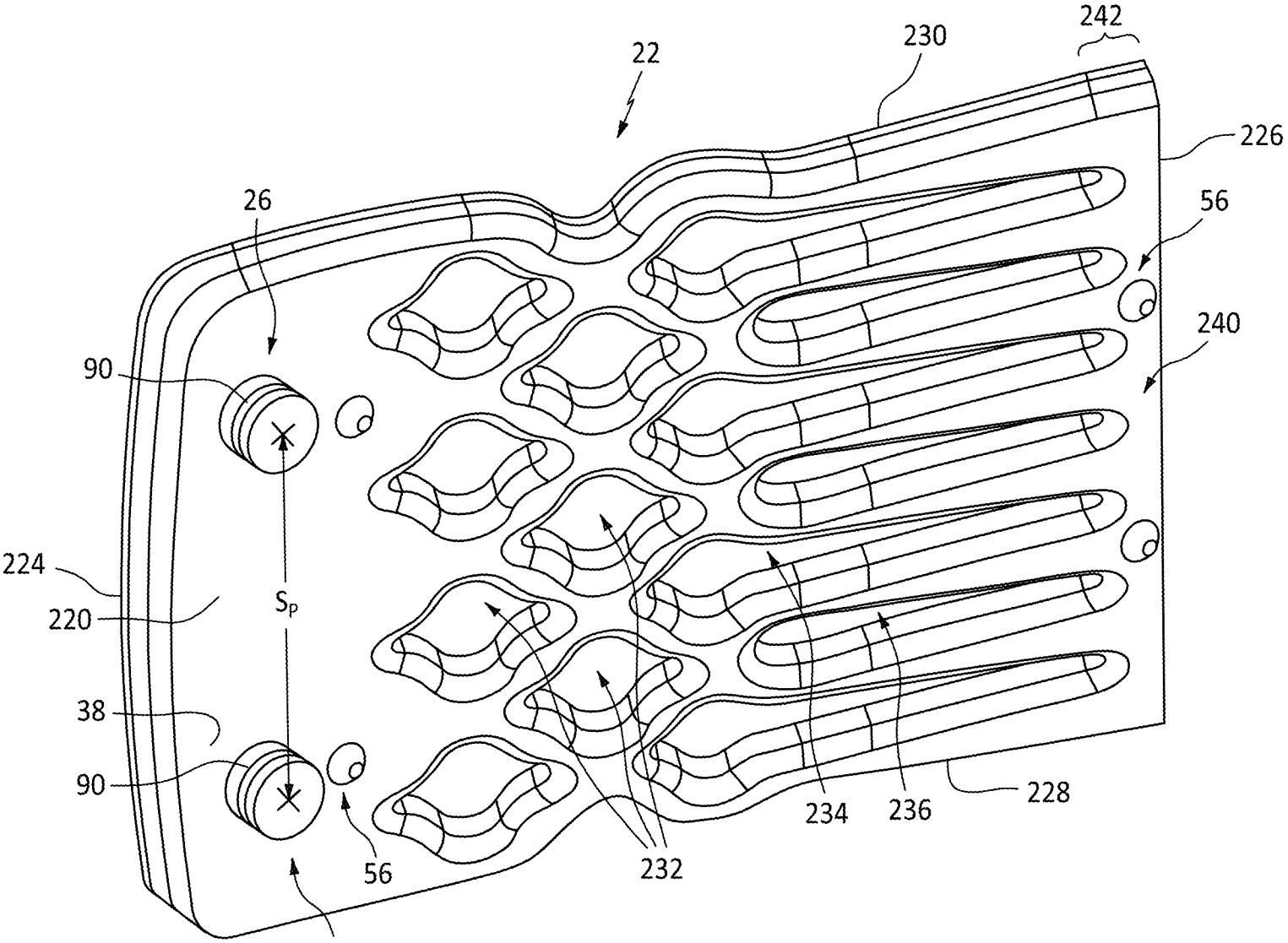
FIG. 2 is a view of an example core having the posts.
Figure 3:
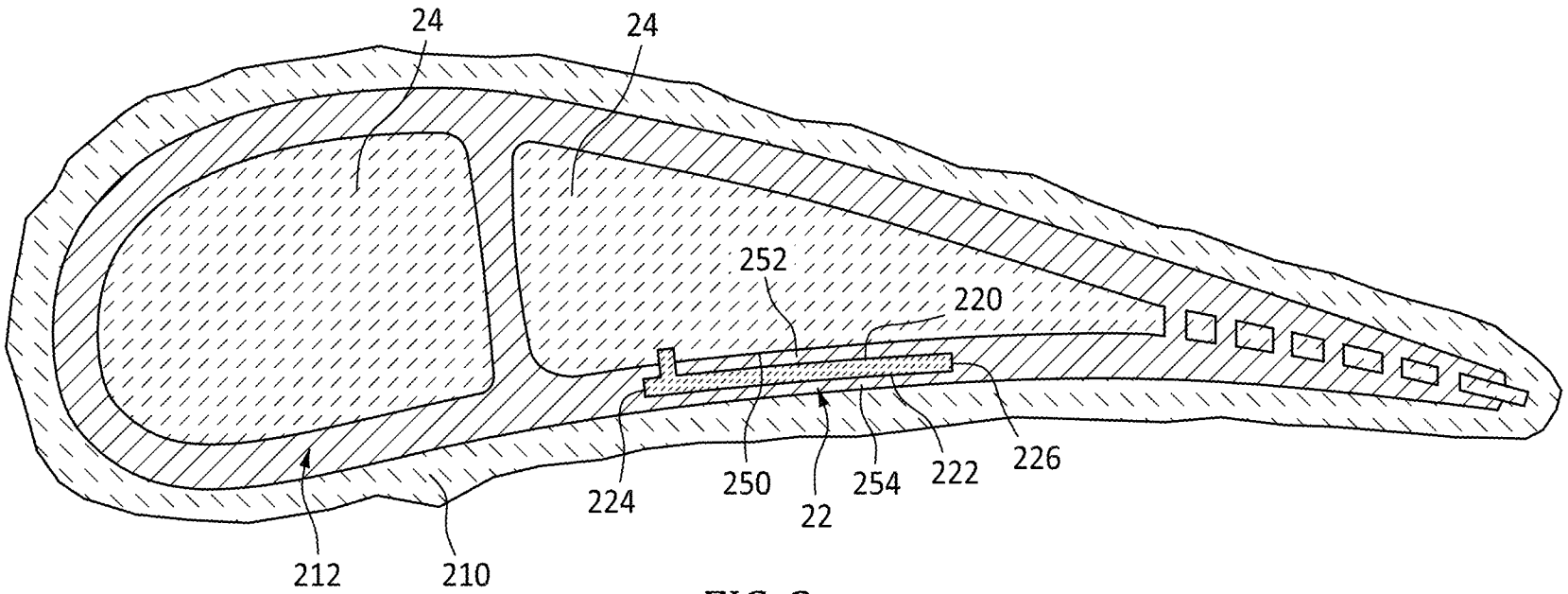
FIG. 3 is a sectional view of an airfoil being cast by a shell containing a core assembly having the post and socket joint.
Figure 4:
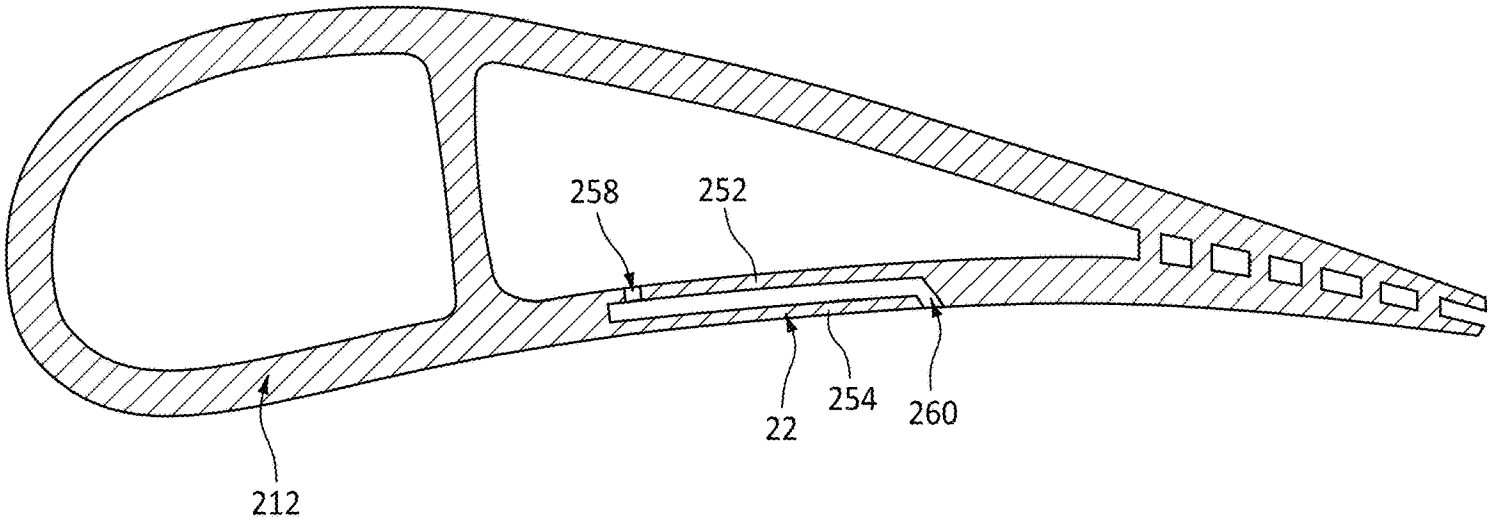
FIG. 4 is a sectional view of the resulting airfoil after outlet hole drilling.
Figure 5:
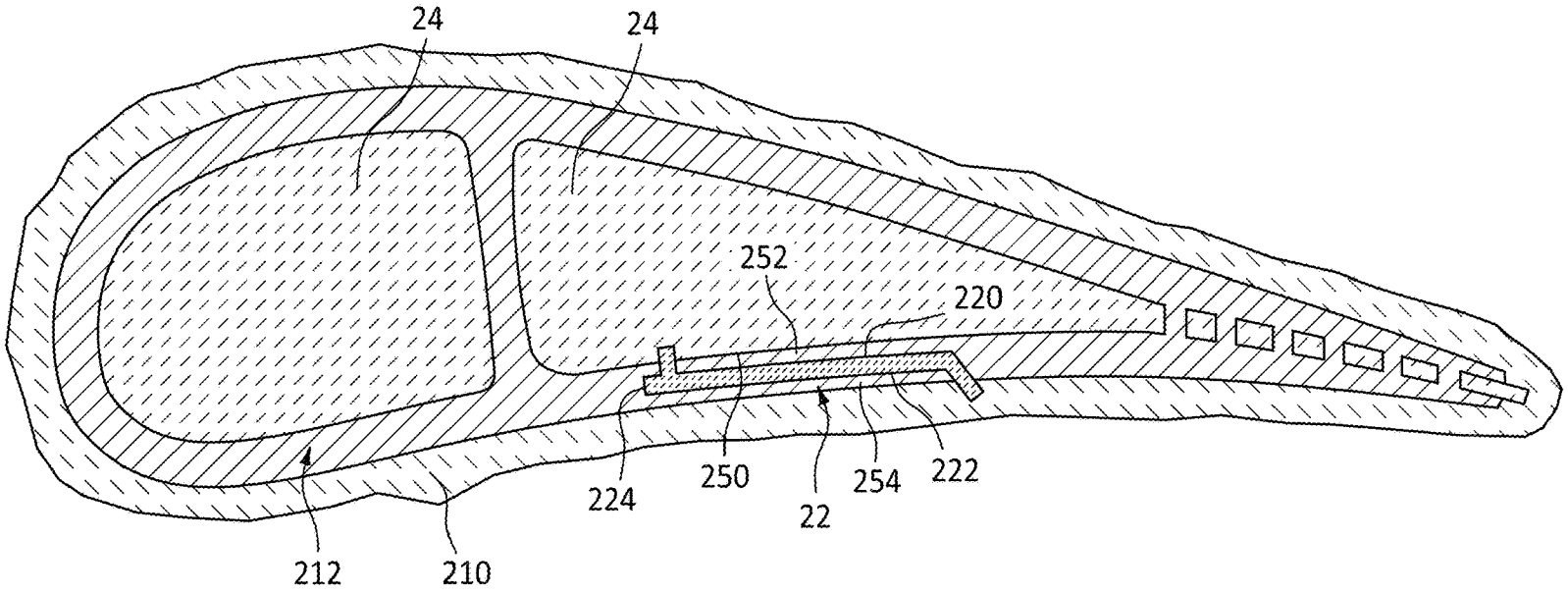
FIG. 5 is a sectional view of an alternate casting shell including a core assembly that itself casts outlets.

FIG. 2 shows one example of the core 22 based on the configuration of the '727 patent. The example has two posts 26 having an on-center spacing Sp. These are in an inboard face 220 which includes the surrounding surface 38. An opposite surface 222 is shown in FIG. 3 discussed below. Core 22 extends from an upstream end 224 to a downstream end 226 and has lateral edges 228 and 230. The core has a series of through holes 232, 234, 236 that cast posts and/or ribs in the associated outlet skin passageway. In this particular example, the holes 234 and 236 segment a plurality of legs which cast generally parallel passageways to outlet passageways discussed below. At the end 226, the legs are joined by intact material 240 in an end region 242. In this particular example, additional bumpers 56 in the end region hold the surface 220 spaced apart from the adjacent surface 250 (FIG. 3) of the core 24 to ensure that interior wall 252 and outer wall 254 are of a desired uniformity of thickness. FIG. 3 shows a schematic assembly of the cores 22 and 24 in a shell 210 casting an airfoil 212. This is a schematic view and in practice there may be additional cores and more complex shapes of cores. After deshelling and decoring (discussed below), outlet holes 260 (FIG. 4) may be drilled into the trailing end of the passageway as cast by the example core 22 (FIG. 4). In FIG. 4, it is seen how the posts have cast passageways 258 that feed the skin passageway from an associated feed passageway cast by the associated section of the core 24. In a further variation for casting of the outlet passageways 260, FIG. 5 shows a modified core wherein a trailing end portion has been bent outward and extended to embed in the shell.

Component materials and manufacture techniques and assembly techniques may be otherwise conventional. Thus, a basic prior art sequence may be used of molding the individual core pieces and firing them to sinter (e.g., in a kiln/furnace). In an example wherein the socket is milled, an additional milling step may form the socket recess. An example additional milling step is using a protuberant ball mill to machine the recess after the end milling cuts a generally cylindrical shape or an evenly tapering shape.

The ceramic paste may be applied (e.g., by injecting into the socket or applying to the tip of the post) and the core pieces may be assembled with posts inserted into the sockets and sufficient pressure applied to displace the paste into the lateral gap 50. The resulting assembly may then heated to cure the paste. For example, it may be fired (e.g., in a kiln/furnace or, perhaps, locally fired such as via torch). Example firing is to a lower temperature than the initial core piece firing and may be below a sintering temperature. Subsequent steps may also be conventional including wax over molding in a wax die to form a pattern, shelling/stuccoing of the pattern, dewaxing and firing to form a shell.

Alloy may be melted and cast in the shell. The resulting raw casting may be deshelled (e.g., mechanical breaking) and decored (e.g., alkaline and/or acid leaching and/or thermo-oxidative removal) and subject to finish machining and subsequent coating or other steps.

Figure 6:
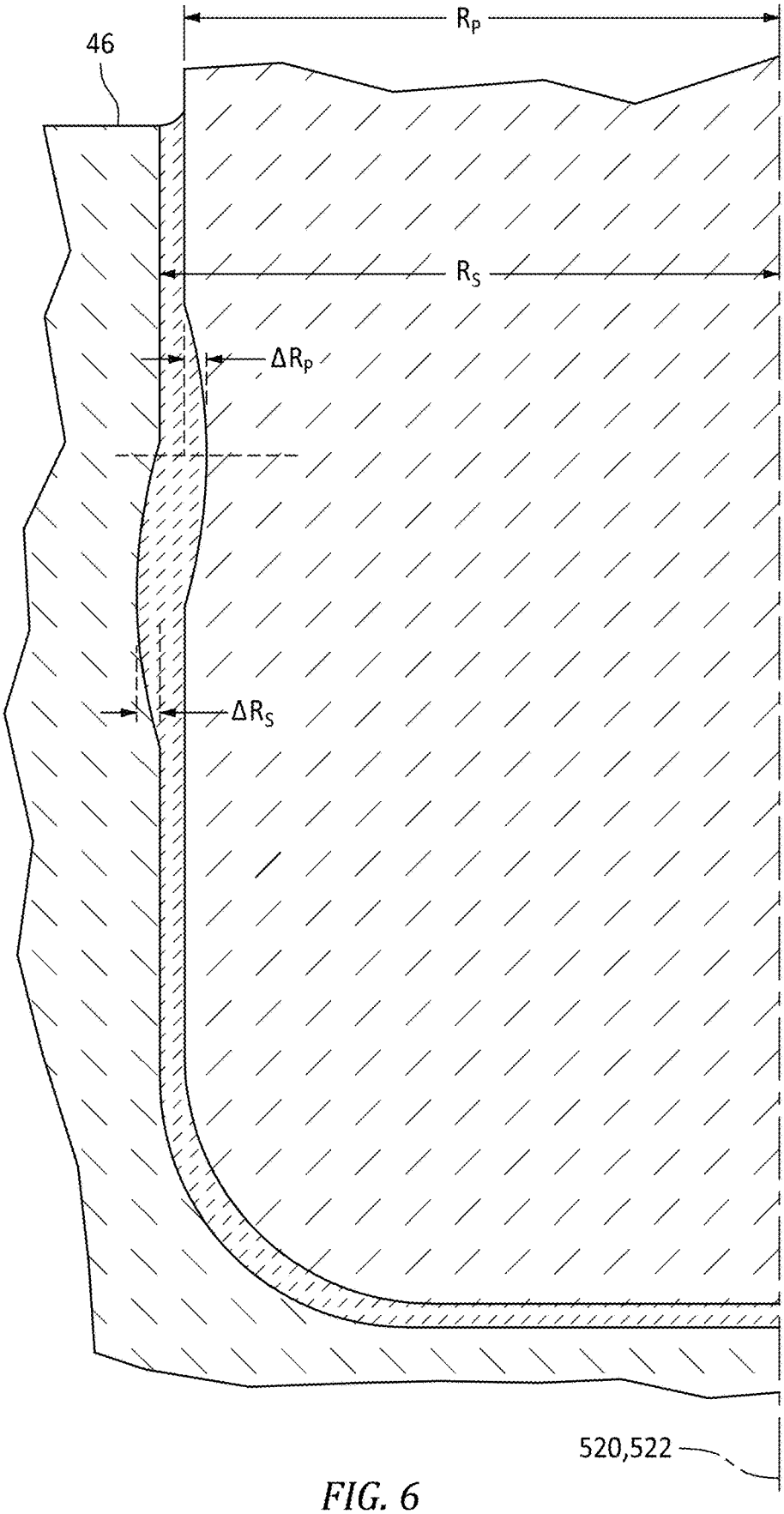
FIG. 6 is a longitudinal sectional view of a first alternate joint.

FIG. 6 shows an alternate joint wherein the relative axial positions of the recesses 90 and 96 are reversed.

Figure 7:
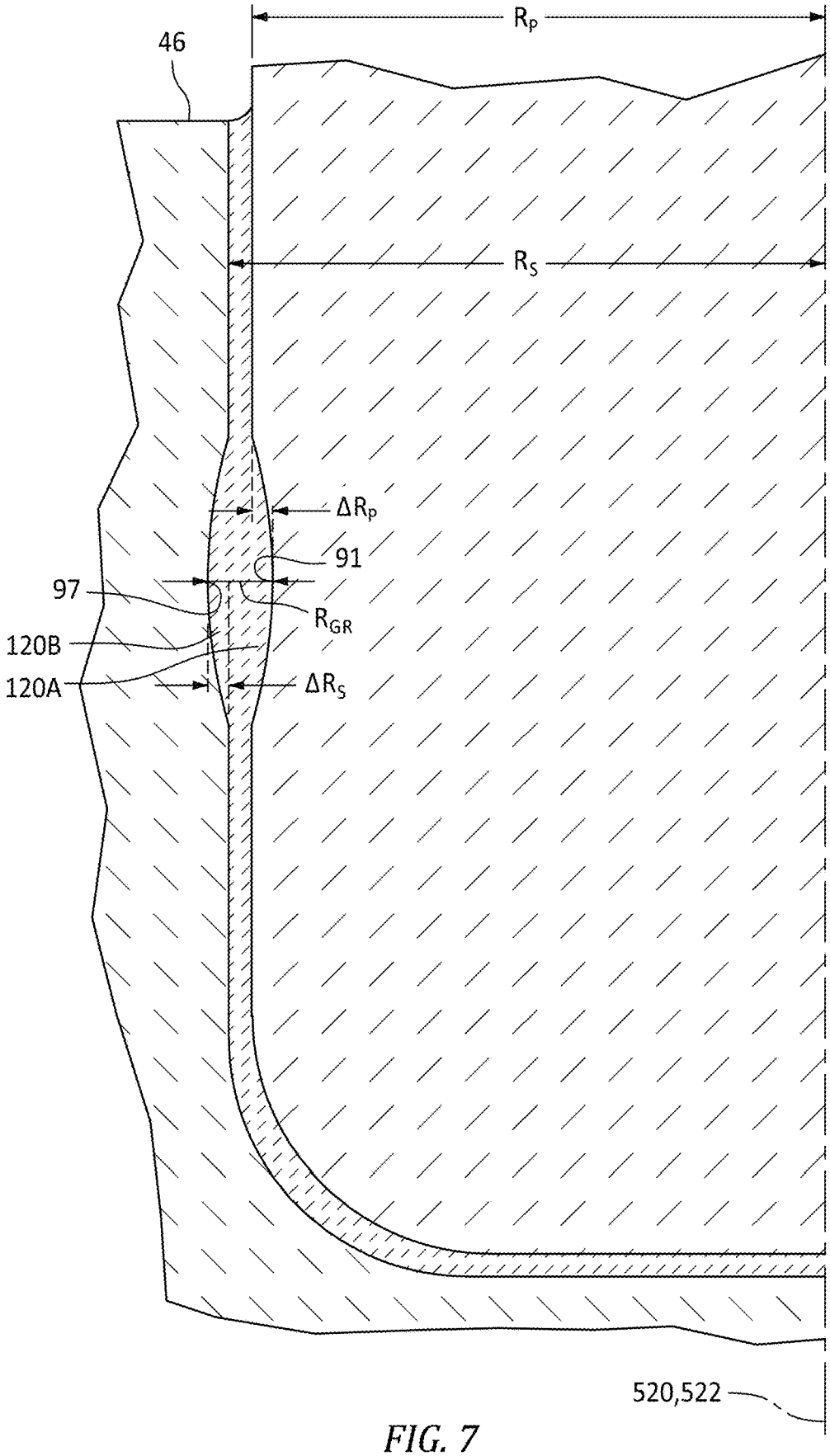
FIG. 7 is a longitudinal sectional view of a second alternate joint.

FIG. 7 shows an alternate joint wherein the recesses are nearly axially aligned with each other.

Figure 8:
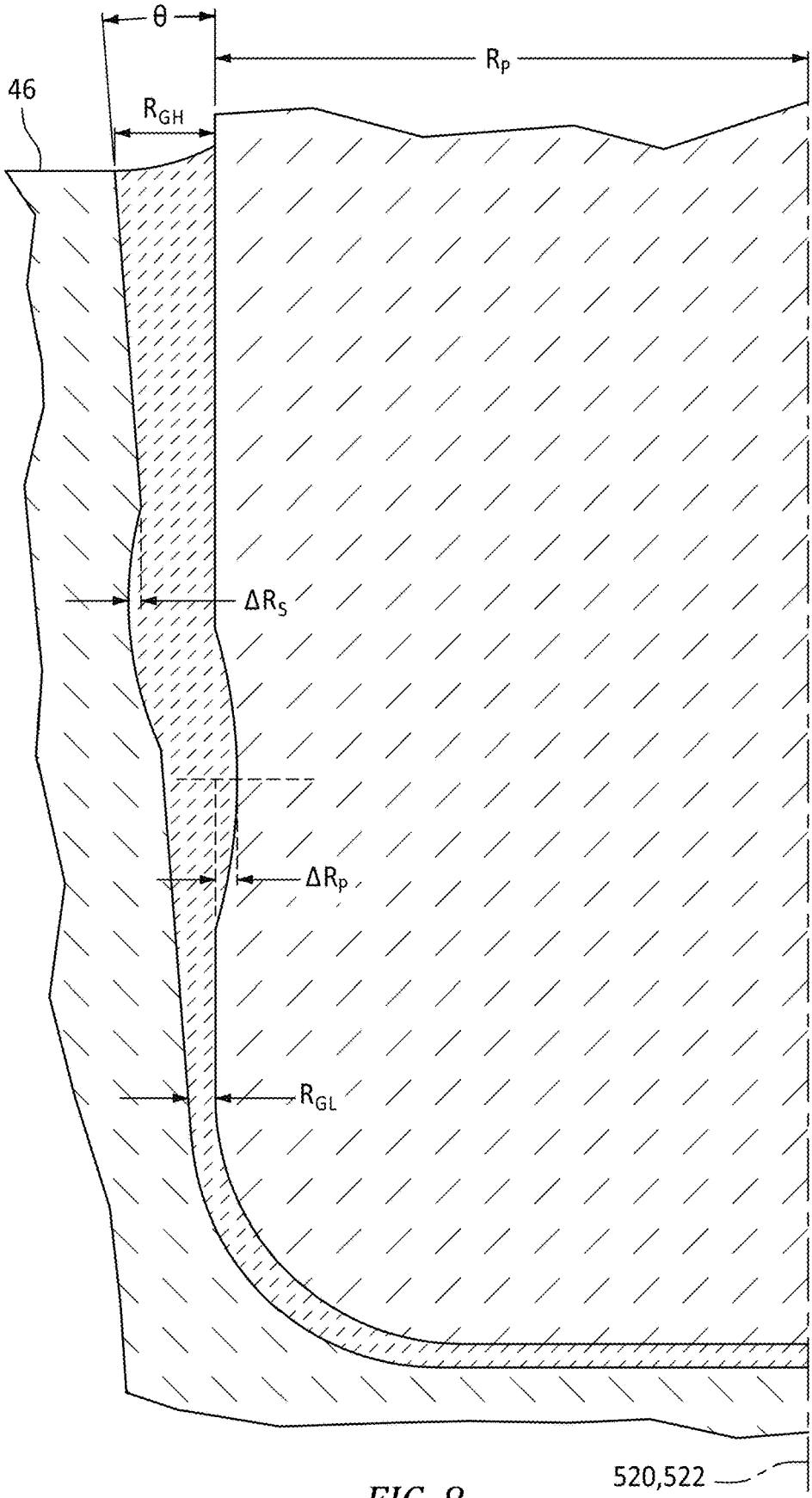
FIG. 8 is a longitudinal sectional view of a third alternate joint.

FIG. 8 shows an alternate joint wherein the socket has a relatively high taper or draft angle. The FIG. 8 embodiment is otherwise similar to the FIG. 1/1A embodiment. Similar high taper/draft variations may be made for the FIGS. 6 and 7 embodiments.

Although specifically illustrated configurations are shown as recesses having two closed ends within the overlap height, other configurations are possible that still provide the backlocking. For example, at one extreme, the post may effectively have a radius $R_P$ generally uniform from the surface 38 into the overlap region then has a head extending slightly radially outward. Similarly, the socket may have a slightly inward radial projection near the surface 46 (alternatively viewed, there may be an outward recess near the base of the socket). It is thus seen that the key aspects to the backlocking are the portion of the post below the recess 90 and the portion of the socket above the recess 96 can effectively be viewed as local lateral protrusions. However, these alternative embodiments may be less desirable because of any of several reasons. They may have excess radial play once inserted. They may have excess thickness of filler, thereby increasing problems of differential shrinkage and thus potential flash generation.

Along a majority of a length of the post away from the post recess, a draft angle of the peripheral surface is 0.25°. More broadly, an example draft is 0° to 0.50°, measured as a half angle rather than a full angle. For a relative shallow taper of the socket, along a majority of a length (depth) of the socket away from the socket recess, a draft angle of the peripheral surface is 0.25°. More broadly, an example draft is 0° to 0.50°, measured as a half angle rather than a full angle.

For an example greater taper, along a majority of a length (depth) of the socket away from the socket recess, a draft angle θ (FIG. 8) of the peripheral surface is about 5°. More broadly, an example draft is 0° to 10.0° or 2.0° to 10.0° or 2.0° to 8.0°, measured as a half angle rather than a full angle.

With relatively small draft angles, even if different from each other, the post and socket may have the aforementioned dimensional relationships/proportions along a substantial fraction of the overlap height in the ranges noted above not withstanding that the individual radii change slightly with height.

However, particularly with a disparity in draft angle, the target relationships may exist over a much smaller fraction of $H_O$. For example, the draft angle of the socket may be greater than the draft angle of the post. This disparity, for example, causes an increase in cross-sectional area of the gap axially outward towards the surface 46. FIG. 8 shows a minimum radial gap $R_{GL}$ just before one or both of post and socket begin to curve inward. It also shows a high gap (potentially ignoring gap at the recesses) $R_{GH}$ at the surface 46. This reduces the sensitivity of the level of the surface of the material 52 relative to the surface 46. For example, even with precise amounts of material introduced, the variations in the height of the bumper/projection/protrusion 56 will influence the depth of penetration of the post into the socket and thus the displacement of material.

FIG. 8 shows a relatively highly tapered (high draft angle) socket in a second piece receiving a relatively less tapered or untapered post. As discussed above, this leads to a greater gap radial span approaching the surface 46 and thus a greater gap cross-sectional area. This greater gap cross-sectional area reduces prospective overflow or under-flow of the material 52 relative to the surface 46. In this example, axial recess overlap is similar to FIG. 1.

A broader radial span of the gap with the tapered socket means that excessive insertion will cause a smaller overflow height of material protrusion beyond the surface 46. This provides more favorable manufacturing tolerances for the wall thickness of the wall cast by the gap 60. For example, a slightly short bumper 56 already reduces wall thickness. Because the overflow imposes a further local thickness reduction on the wall, there can be problems. The tapered socket reduces that further local reduction relative to what it otherwise would have been. Similarly, in an under-flow situation where the surface of the material 52 does not reach the surface 46, the height of the burr in the passageway cast by the core 24 is smaller and may be more likely to be within manufacturing tolerance.

Among variations, other features may be added such as the slots of the '727 patent. Additionally, the principles may be applied to other configurations of core and manufacture technique. Although the example annular recesses are full 360° annulus, the recesses may have other extents and/or the identified dimensions may be present over other extents (e.g., a full annular recess having the identified dimensions over only a portion). Such recesses or the associated dimensions may exist over smaller annular sectors such as at least 8.0° or at least 15.0° or at least 30.0° or at least 60° individually. For essentially full annuli that may be interrupted by some other feature or defect, example angles are at least 300° or at least 330°. Relatedly, the post and/or socket may be other than circular in cross-section/footprint and the recess or protrusion (depending on viewpoint as discussed above) may fully or partially circumscribe, representing a similar fraction of perimeter to that described for the circular section or similar reduction in cross-sectional area, etc.

Examples of such variations in post and/or socket cross-sections/footprints are found in U.S. patent application Ser. No. 18/779,406, "Casting Core Post and Socket Joint", of Anthony J. Del Boccio, filed Jul. 22, 2024, (the '406 application). The disclosure of the '406 application is incorporated by reference in its entirety herein as if set forth at length. In some embodiments, the inward reliefs in the post or outward reliefs in the socket of the '406 application may combine with the present circumferential relief to limit the backlocking effect to spaced circumferential locations between the '406 application reliefs (or at least locally substantially reduce it at certain locations) while leaving it fully intact in the alternating locations.

Figure 9:
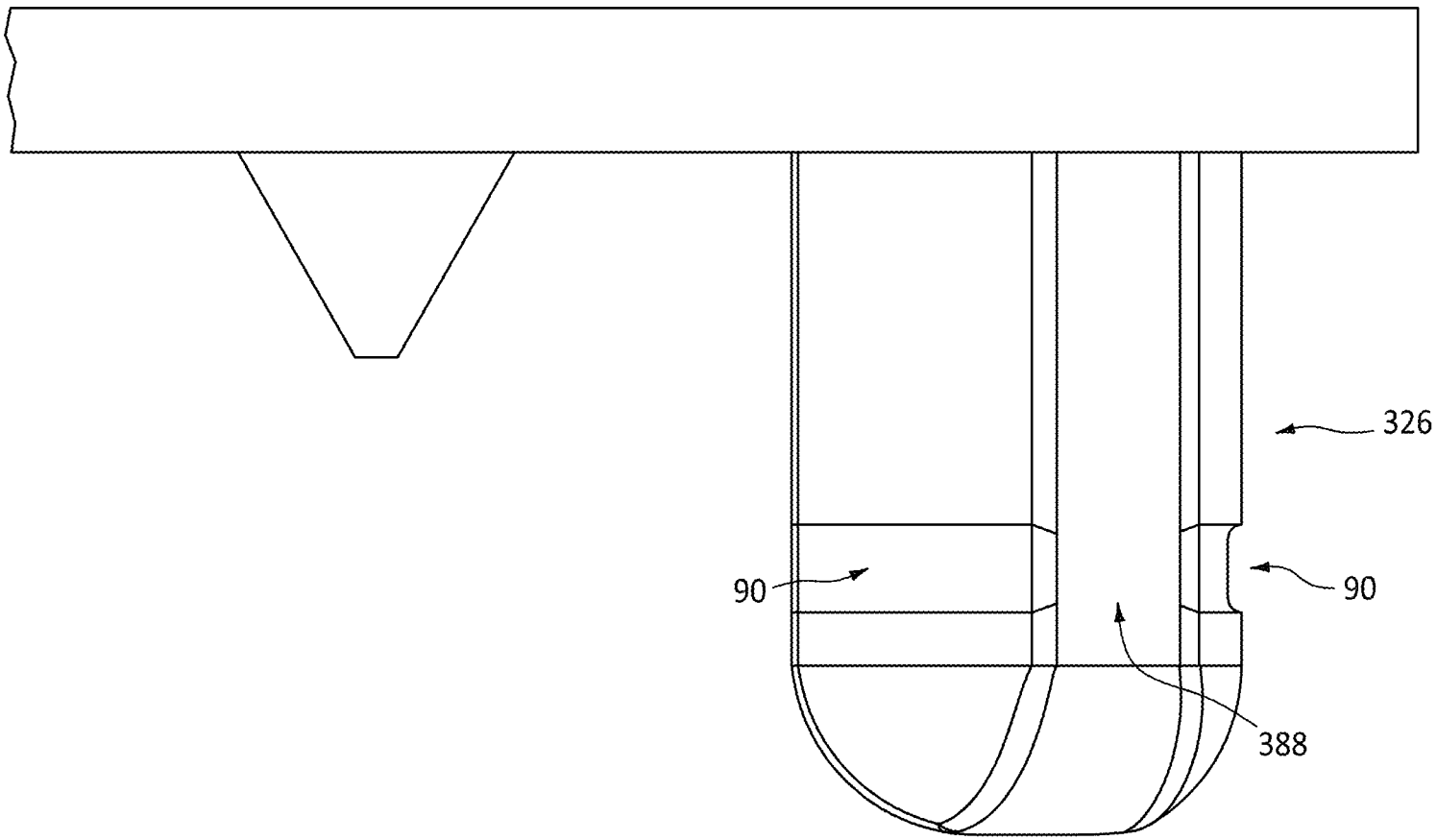
FIG. 9 is a partial side view of an alternate core having posts.
Figure 10:
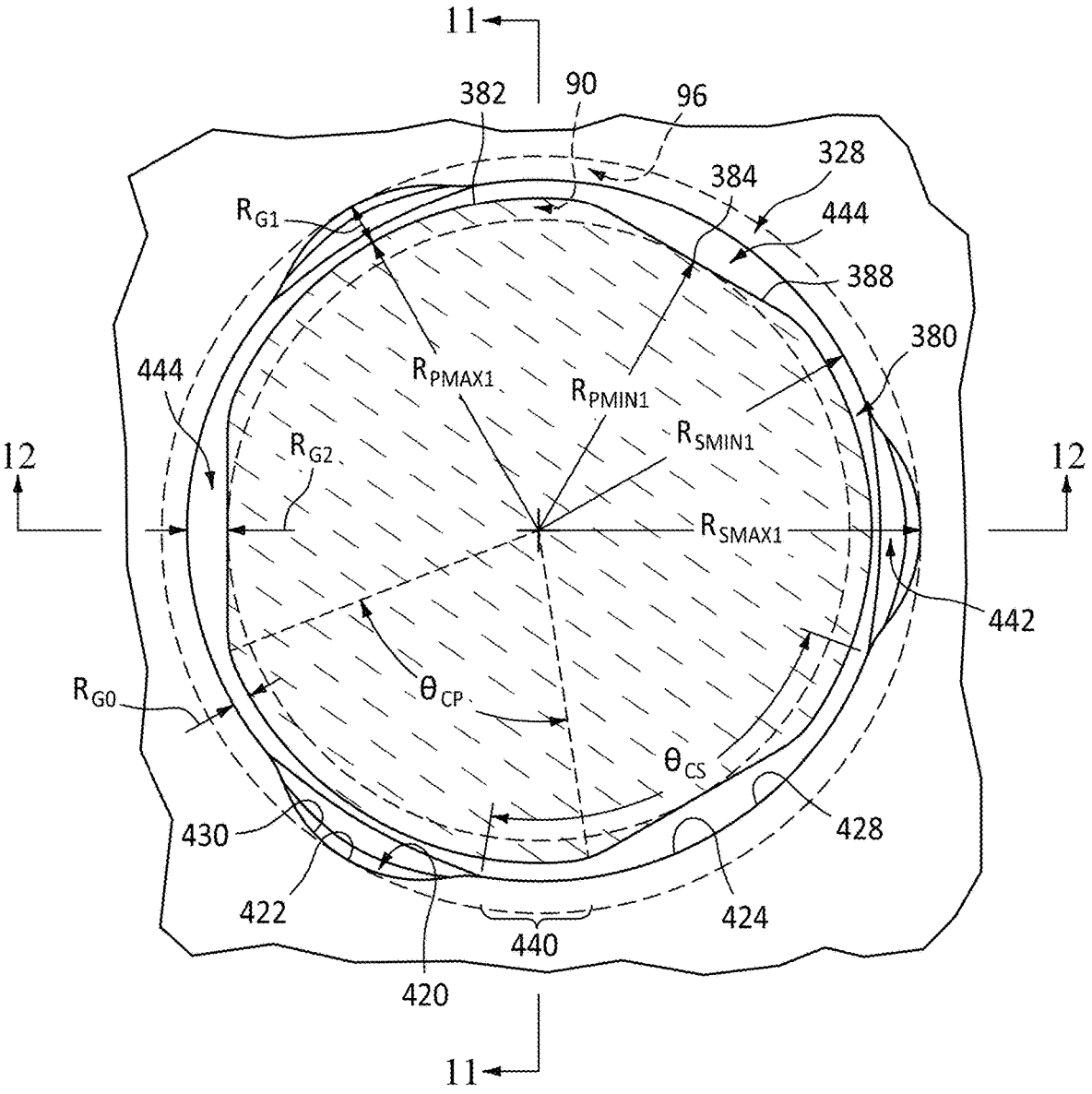
FIG. 10 is a transverse sectional view of a joint without bonding agent for illustration and including the FIG. 9 core.
Figure 11:
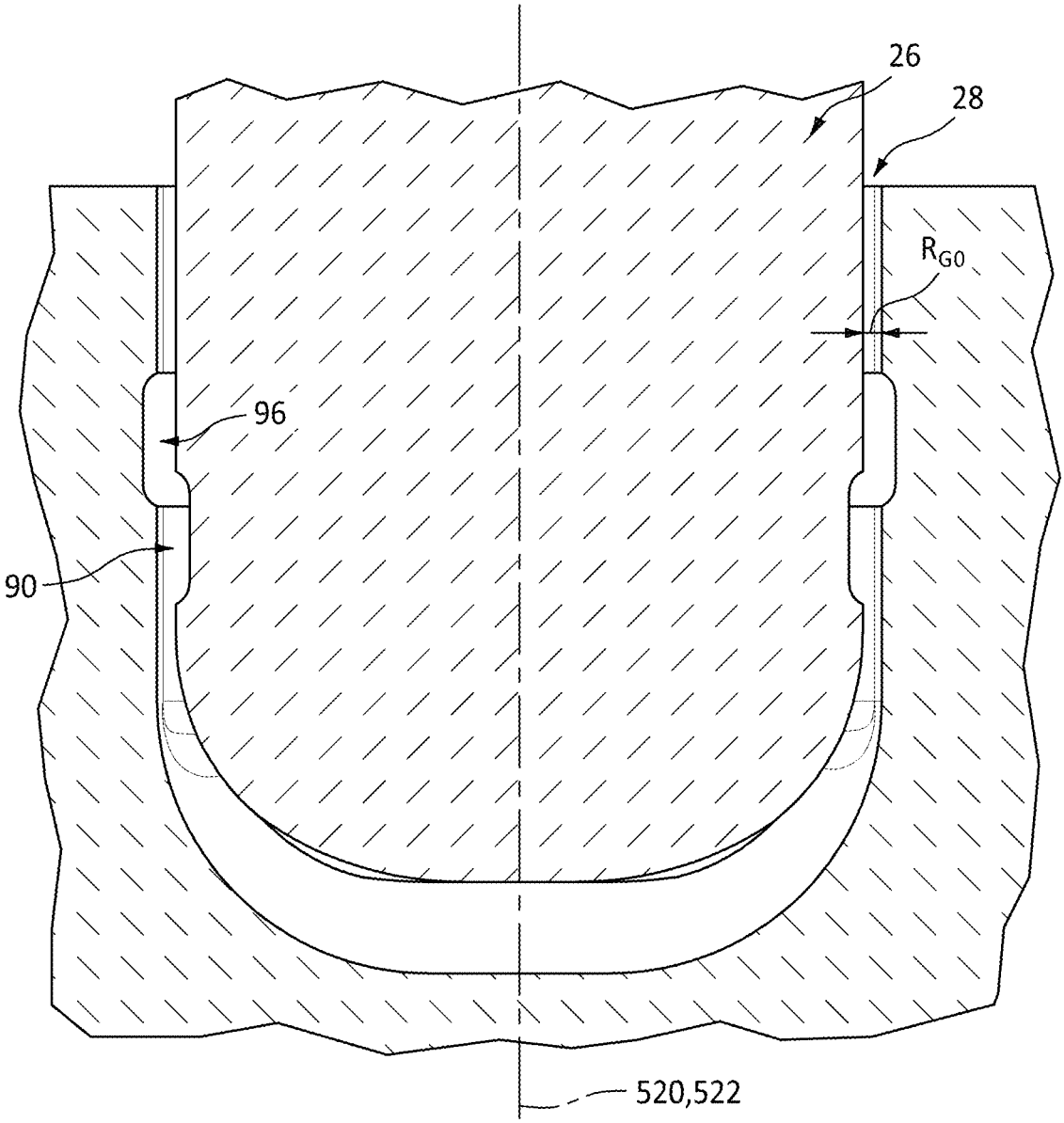
FIG. 11 is a longitudinal sectional view of the FIG. 10 joint taken along line 11-11 of FIG. 10.
Figure 12:
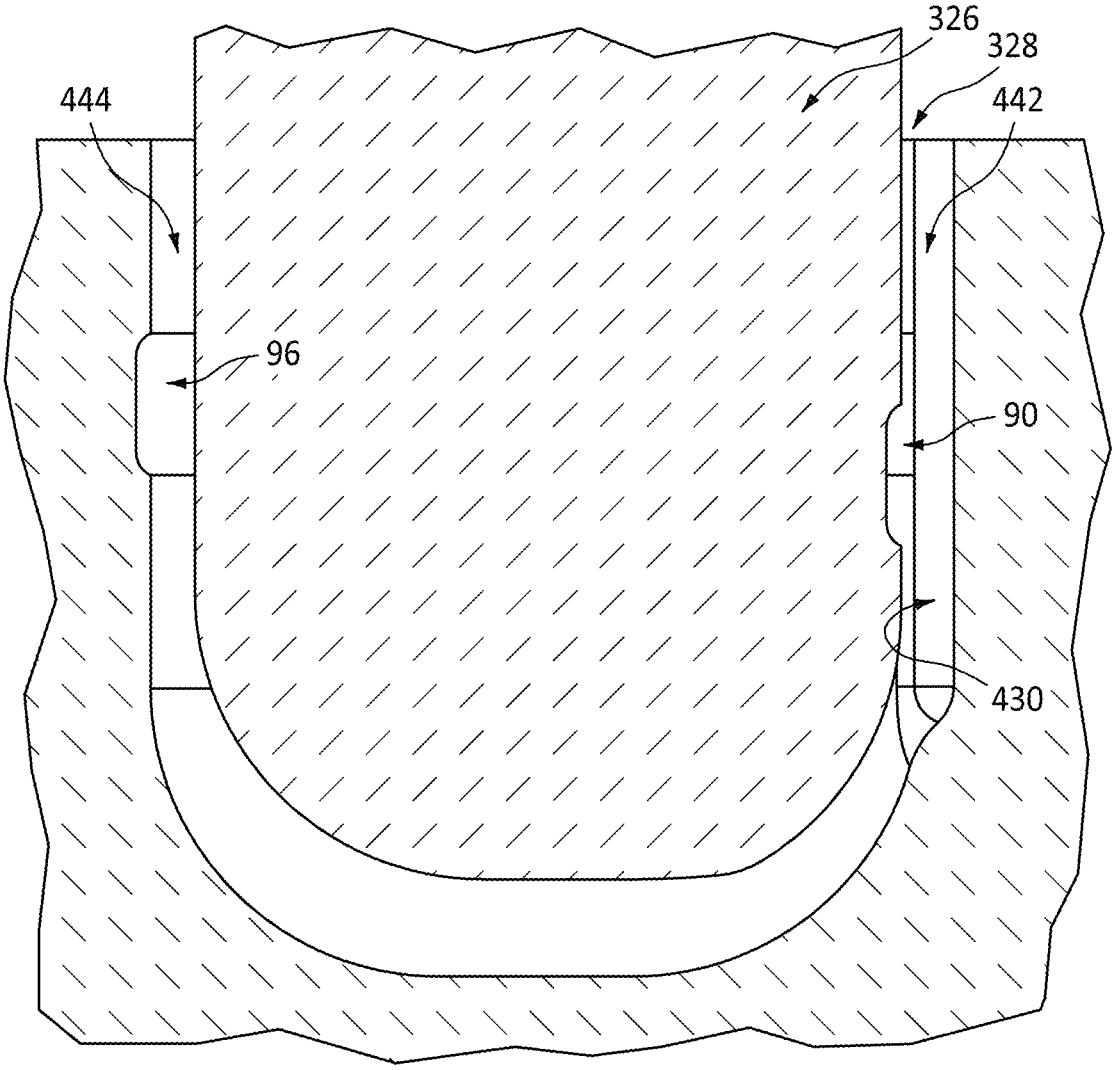
FIG. 12 is a longitudinal sectional view of the FIG. 10 joint taken along line 12-12 of FIG. 10.

FIGS. 9-12 show such a post and socket arrangement with both: longitudinally-extending radial reliefs in the post (flats 388 of FIG. 9, relieved relative to intact circular surface (angular span thus actual concave recesses are also possible); and longitudinally-extending radial reliefs 'in the socket (recesses 430 in FIG. 10). These are shown out of phase with areas 440 of overlapping unrelieved post and socket. These longitudinal radial reliefs improve flow when the post is inserted into the socket and displaces the adhesive or filler. Nevertheless, various embodiments may have only reliefs on the posts or only reliefs in the sockets. The FIGS. 9-12 recesses 90, 96 are shown as less gradual and less arcuate than their FIGS. 1A, and 6-8 counterparts. Nevertheless, they may be alternatively shaped and positioned such as in said counterparts and vice versa.

The FIG. 9 post 326 cross-section above and below the recess 90 has three evenly circumferentially spaced lobes 380 (FIG. 10) with radial maxima of radius $R_{PMAX1}$ at locations 382 and three evenly spaced radial minima of radius $R_{PMIN1}$ at locations 384 exactly out of phase with the maxima. The example maxima are intact portions of a circular section (having angular span $\theta_{CP}$) that may correspond to the circular section of the baseline post.

The example minima 384 are centrally along flats 388 (straight lines in the transverse sectional view of FIG. 10). The example maxima are true peaks; whereas, the example minima are not true troughs. True troughs would reflect a local concavity in the peripheral surface. The example cross-section has regions of convexity centered on the maxima transitioning to straight regions centered on the minima. However, when plotted as radius against angular position for 360° cycle, the maxima represent peaks and the minima represent troughs. The example flats may be exact flats or may be substantial flats or may be arcs with substantially greater radii of curvature than that their actual local radii or the radius of curvature at the maxima. Example radii of curvature substantially are at least 500% or at least 1000% of the local radii or the radius of curvature along the maxima. There may even be local concavity at the minima, however that may reduce post strength and the additional surface area may resist flow and if extending into the gap it may further reduce the area of the feed hole it casts.

The socket 328 cross-section has three evenly circumferentially spaced lobes 420 with radial maxima at locations 422 and three evenly spaced radial minima at locations 424 exactly out of phase with the maxima. The example minima are intact portions 428 of a circular section (having angular span $\theta_{CS}$) that may correspond to the circular section of the baseline socket. The example maxima are centrally along recesses 430 (convex outward in the transverse sectional view of FIG. 10) in the wall of the socket. Height-wise, there are overlap subregions Outward of the recess 96 and inward of the recess 90) where both the post and the socket have such fully formed features 388 and 430. The socket maxima are along inward concavities of the surface that convexly transition at circumferential ends to the concavity where the minima occur. The latter may be intact portions of a circle.

The socket recesses at lobes 420 (FIG. 10) have a peak radius $R_{SMAX1}$. The intact circular portions define a socket minimum radius $R_{SMIN1}$. The angular spans $\theta_{CP}$ and $\theta_{CS}$ are sized so that there is overlap region 440 of intact circular surface portions of the post and socket surfaces which would share local nominal radial gap $R_{GO}$ with the baseline if engineered therefrom by merely eliminating material at the post flats and socket recesses (e.g., preserving $R_P$ as $R_{PMAX1}$ and $R_S$ as $R_{SMIN1}$). For this, $\theta_{CP}+\theta_{CS}>120°$ for the three-cycle/lobe/recess configuration. example $\theta_{CP}+\theta_{CS}$ is 130° to 160°, more narrowly 140° to 155° or about 150°. An example overlap span of region 140 is 10° to 40° or 20° to 35° or 20° to 35°. Example $\theta_{CP}$ may be slightly smaller than $\theta_{CS}$. With the example sum of 150°, example $\theta_{CP}$ is 62° and example $\theta_{CS}$ is 88°. More broadly, example $\theta_{CP}$ is 50° to 90°, more particularly 55° to 80° and example $\theta_{CS}$ is 60° to 105°, more particularly 75° to 95°.

Centered, the radial gap at the post peaks is a radial clearance $R_{G1}$ and at the post troughs $R_{G2}$. These effectively create two groups of three enhanced radial span channels (radially enhanced portions of the annular gap) 442, 444 to facilitate flow of paste/slurry upon insertion of the post into the socket. Each channel 442 is diametrically opposite an associated channel 444.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline configuration or manufacture process, details of such baseline may influence details of particular implementations. Accordingly, other embodiments are within the scope of the following claims.

What is claimed is:

1. A casting core assembly comprising:
a first ceramic piece including an integrally molded projecting post;
a second ceramic piece including a socket encircling the post; and
a ceramic filler material between the post and the socket, wherein at least one of:
in axial section at at least one location the post has:
a lateral protrusion of at least 15 micrometers relative to a location proximal thereof; and
in axial section at at least one location the socket has:
a lateral recess of at least 15 micrometers relative to a location outboard thereof.

2. The casting core assembly of claim 1 wherein:
the socket is a closed-ended socket.

3. The casting core assembly of claim 1 wherein at least one of:
the protrusion is full annulus; and
the recess is full annulus.

4. The apparatus of claim 1 wherein both of:
the post has said lateral protrusion; and
the socket has said lateral recess.

5. The casting core assembly of claim 4 wherein:
the protrusion is full annulus; and
the recess is full annulus.

6. The casting core assembly of claim 4 wherein:
the protrusion has an outward extreme; and
the recess has an outward extreme axially outboard of the protrusion outward extreme.

7. The casting core assembly of claim 4 wherein:
the protrusion is formed as a distal wall section of a full annulus recess in the post, a proximal wall section also being in the socket; and
the recess is full annulus.

8. The casting core assembly of claim 1 and further comprising:
a second said post and a second said socket and a ceramic filler material between the second post and the second socket.

9. The casting core assembly of claim 1 wherein:
the protrusion forms a distal wall of a post recess; and
the recess is recessed relative to portions of the socket inward and outward thereof.

10. The casting core assembly of claim 1 wherein:
a separation Ho between the first ceramic piece and the second ceramic piece aside the projection and the socket is 0.35 mm to 2.0 mm.

11. The casting core assembly of claim 1 wherein:
in transverse section at at least one further location one of the post and the socket has a configuration of:
three circumferentially offset radial peaks of a peak radius ($R_{PMAX1}$, $R_{SMAX1}$); and
three radial troughs of a trough radius ($R_{PMIN1}$, $R_{SMIN1}$) not more than 98.0% of the peak radius.

12. The casting core assembly of claim 1 wherein:
the second ceramic piece forms a feedcore; and
the first ceramic piece forms a skin core.

13. The casting core assembly of claim 1 wherein:
the first ceramic piece has one or more bumpers protruding to contact the second ceramic piece.

14. A method for manufacturing the casting core assembly of claim 1, the method comprising:
introducing a ceramic paste into the socket; and
inserting the post into the socket, the inserting displacing the ceramic paste, the ceramic paste hardening to form the ceramic filler material.

15. The method of claim 14 further comprising forming the second ceramic piece by:
molding; and
machining the socket, the machining including an orbit of a ball mill cutting the recess.

16. The method of claim 15 wherein:
the ball mill cutting is into a wall surface formed by ball end mill cutting with a different bit.

17. A method for using the casting core assembly of claim 1, the method comprising:
wax overmolding;
shelling to form a shell; and
casting an alloy in the shell.

18. The method of claim 17 further comprising:
deshelling and decoring.

19. A casting core assembly comprising:
a first ceramic piece including an integrally molded projecting post;
a second ceramic piece including a socket encircling the post; and
a ceramic filler material between the post and the socket, wherein at least one of the post and the socket has a full annular recess into which the ceramic filler material extends to axially backlock said at least one to the ceramic filler material.

20. A casting core assembly comprising:

a first ceramic piece including an integrally molded projecting post;

a second ceramic piece including a socket having an axis; and a ceramic filler material between the post and the socket, wherein the ceramic filler is axially backlocked to the post and the socket to prevent nondestructive axial extraction of the post from the socket.

21. The casting core assembly of claim 20 wherein:

the ceramic filler is axially backlocked to the post and the socket by at least 10 micrometers.

22. The casting core assembly of claim 20 wherein:

each of the post and the socket has a full annular recess into which the ceramic filler material extends.

* * * * *